US005730662A

United States Patent [19]

Rens

[11] Patent Number: 5,730,662

[45] Date of Patent: Mar. 24, 1998

[54] GRIP ASSEMBLY AND METHOD

[76] Inventor: Peter J. Rens, 3505 Horton St., Apt 203, Raleigh, N.C. 27607

[21] Appl. No.: 734,531

[22] Filed: Oct. 21, 1996

[51] Int. Cl.[6] ..... A63B 53/00; A63B 49/00

[52] U.S. Cl. ..... 473/300; 473/549; 473/568; 16/DIG. 12; 81/489

[58] Field of Search ..... 473/300, 549, 473/568, 173, 183, 194; 16/110 R, DIG. 12; 81/489

[56] References Cited

U.S. PATENT DOCUMENTS

| | | | |
|---|---|---|---|
| 1,701,856 | 2/1929 | Kraeuter | 473/300 |
| 1,890,037 | 12/1932 | Johnson | 473/300 |
| 3,614,100 | 10/1971 | Spitz | 473/549 |
| 4,053,676 | 10/1977 | Kaminstein | 473/549 X |
| 4,133,529 | 1/1979 | Gambino | 473/300 X |
| 4,819,939 | 4/1989 | Kobayashi . | |
| 4,934,024 | 6/1990 | Sexton, I . | |
| 5,087,042 | 2/1992 | Solheim . | |
| 5,134,008 | 7/1992 | Alm . | |
| 5,258,088 | 11/1993 | Wu . | |
| 5,322,290 | 6/1994 | Minami | 473/300 X |
| 5,355,552 | 10/1994 | Huang . | |
| 5,419,031 | 5/1995 | McLendon . | |
| 5,460,372 | 10/1995 | Cook . | |
| 5,524,885 | 6/1996 | Heo | 473/300 X |
| 5,571,050 | 11/1996 | Huang | 473/300 |

*Primary Examiner*—Raleigh W. Chiu
*Attorney, Agent, or Firm*—Rosenthal & Putterman

[57] ABSTRACT

A grip for an apparatus having a shaft comprises an elongate hollow sleeve adapted to be slidably inserted on to the shaft and is shrinkable upon the application of heat at a preselected temperature range so that the sleeve contracts and surroundingly attaches to the shaft. A tubular member is adapted to be slidably inserted over the sleeve such that the sleeve and the tubular member together form an easily attachable grip. In a further aspect of the invention the sleeve and/or the tubular member are provided with an adhesive. The adhesive may take the form of a two part curable adhesive such as an epoxy. One of the parts is applied to the outer surface of the sleeve and the other part is applied to the interior surface to the tubular member such that the parts mix upon sliding of the grip sections upon one another. In another embodiment of the invention, the two part adhesive is applied to either the exterior of the sleeve or the interior of the tubular member. One of the parts is encapsulated within rupturable microcapsules such that when the respective grip sections slide over one another, the microcapsules rupture, resulting in mixing of the epoxy components and the formation of an integral grip upon curing of the epoxy.

25 Claims, 6 Drawing Sheets

GRIP ASSEMBLY AND METHOD

FIELD OF THE INVENTION

This invention relates generally to the field of hand grips for use on tool and recreational equipment shafts and more particularly to grips employed on golf clubs.

BACKGROUND OF THE INVENTION

Grips are found on virtually every type of hand tool, sport rackets and clubs. Each of the foregoing therefore requires an grip to be provided at the time of sale and often, if the equipment is frequently used, the grip must be replaced.

The grip that is provided when the product is purchased new is often applied with sophisticated and expensive molding equipment. However, when a replacement grip is applied by the consumer, it can be a time consuming and messy process which yields less than optimal results. For example, the grip portions of tennis rackets and baseball bats are often wound with a sticky gauze material to reinforce an existing grip. In addition, another replacement grip is disclosed in U.S. Pat. No. 5,419,031 to McLendon which teaches a golf club grip that is shipped to the consumer in an inside out state. The grip is placed on the shaft and is unrolled on the shaft by the consumer. Another golf grip is disclosed in U.S. Pat. No. 5,258,088 and provides for a solvent to be sprayed on to the club shaft. The grip assembly is coated with a layer of resin over the interior surface thereof such that when the grip is slid on to the shaft, the resin is dissolved into a glue that secures the rod inside the sleeve. After insertion of the rod into the sleeve and after the setting of the glue, the rod and the sleeve are incorporated into a unitary golf grip assembly. Thus, it will be seen that the foregoing grips are not without their inherent drawbacks and deficiencies.

In view of the foregoing, it would therefore be of commercial value to provide a grip system which overcomes the drawbacks and deficiencies of the prior art grips.

Accordingly, it is an object of the present invention to provide a grip that may be easily inserted onto a shaft for both original and replacement grips.

Another object of the present invention is to provide an improved grip which, once attached, may be easily removed.

Yet another object of the present invention is to provide an improved grip which is inexpensive.

A still further object of the present invention is to provide an improved grip which is simple to manufacture.

SUMMARY OF THE INVENTION

The foregoing objects are accomplished by providing a grip for an apparatus having a shaft. The grip comprises an elongated hollow sleeve adapted to be slidably inserted on to the shaft and is shrinkable upon the application of heat at a preselected temperature range so that the sleeve contracts and surroundingly attaches to the shaft. A tubular member is adapted to be slidably inserted over the sleeve such that the sleeve and the tubular member together form an easily attachable grip.

In a further aspect of the invention the sleeve and/or the tubular member are provided with an adhesive. The adhesive may take the form of a two part curable adhesive such as an epoxy. One of the parts is applied to the outer surface of the sleeve and the other part is applied to the interior surface to the tubular member such that the parts mix upon sliding of the grip sections upon one another.

In another embodiment of the invention, the two part adhesive is applied to either the exterior of the sleeve or the interior of the tubular member. However, one of the parts is encapsulated within rupturable microcapsules such that when the respective grip sections slide over one another, the microcapsules rupture, resulting in mixing of the epoxy components, whereby an integral grip is formed upon curing of the epoxy.

BRIEF DESCRIPTION OF THE DRAWINGS

Some of the features and advantages of the invention having been briefly stated, others will appear from the detailed description which follows, when taken in connection with the accompanying drawings in which.

DETAILED DESCRIPTION OF THE ILLUSTRATED EMBODIMENTS

While the present invention will be described more fully hereinafter with reference to the accompanying drawings, in which particular embodiments are shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Referring more specifically to the drawings, it will be noted that the grip is illustrated as being mounted on the end of a generic shaft S. The present invention is intended to broadly include any type of grip, including, but not limited to golf grips, baseball bats, rackets (tennis, racquetball, bad mitten, cricket, squash, table tennis, etc.), bicycle handle bars as well as all types of tools having a grip. Notwithstanding the foregoing, specification which follows make reference to a golf grip, however, this is for ease of description and readability only and is not to be inferred as limiting upon the invention.

Figure 1A:
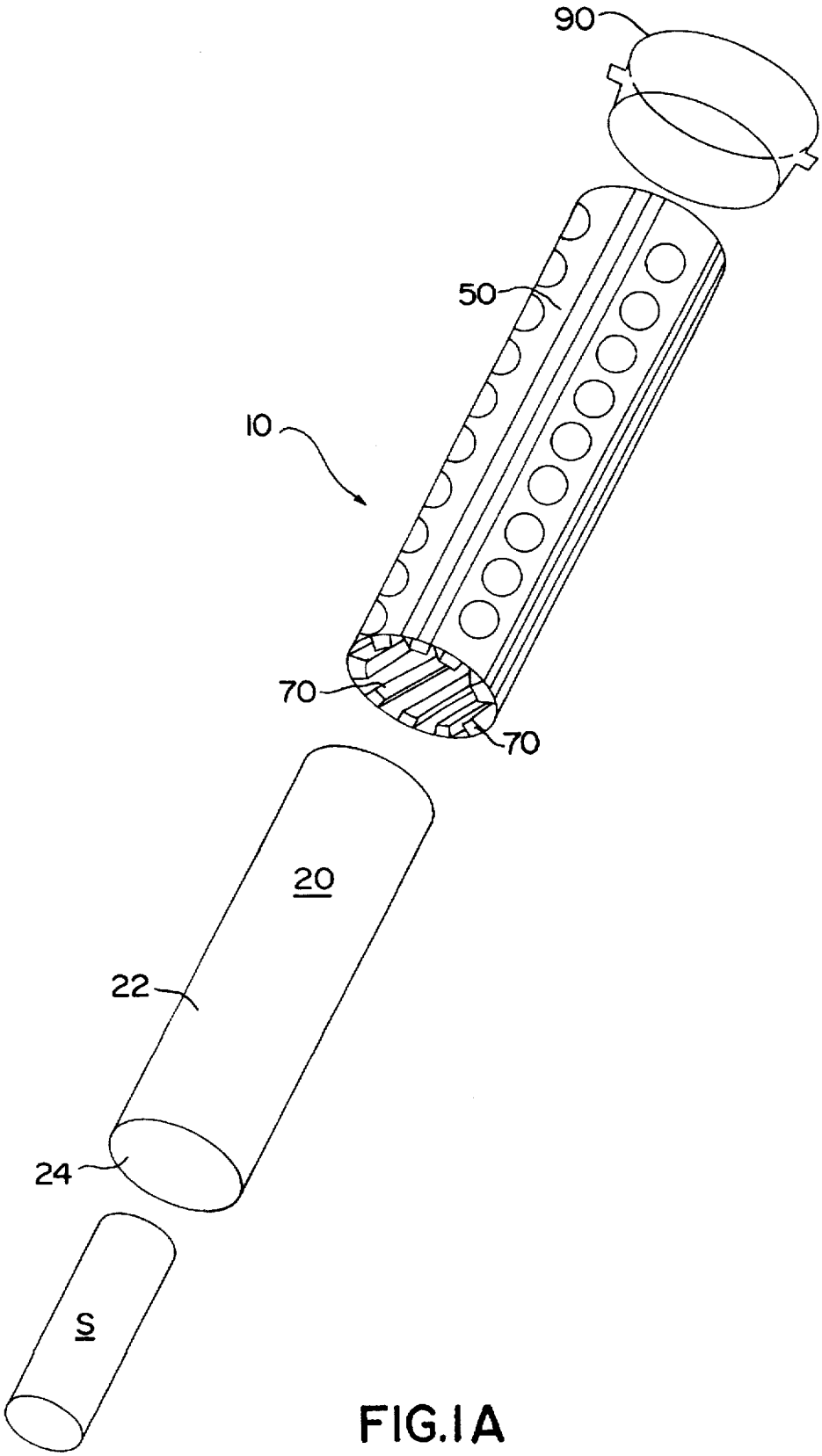
FIG. 1*a* is an exploded view, taken in perspective of the grip according to the present invention mounted on the end of a shaft.
Figure 1B:
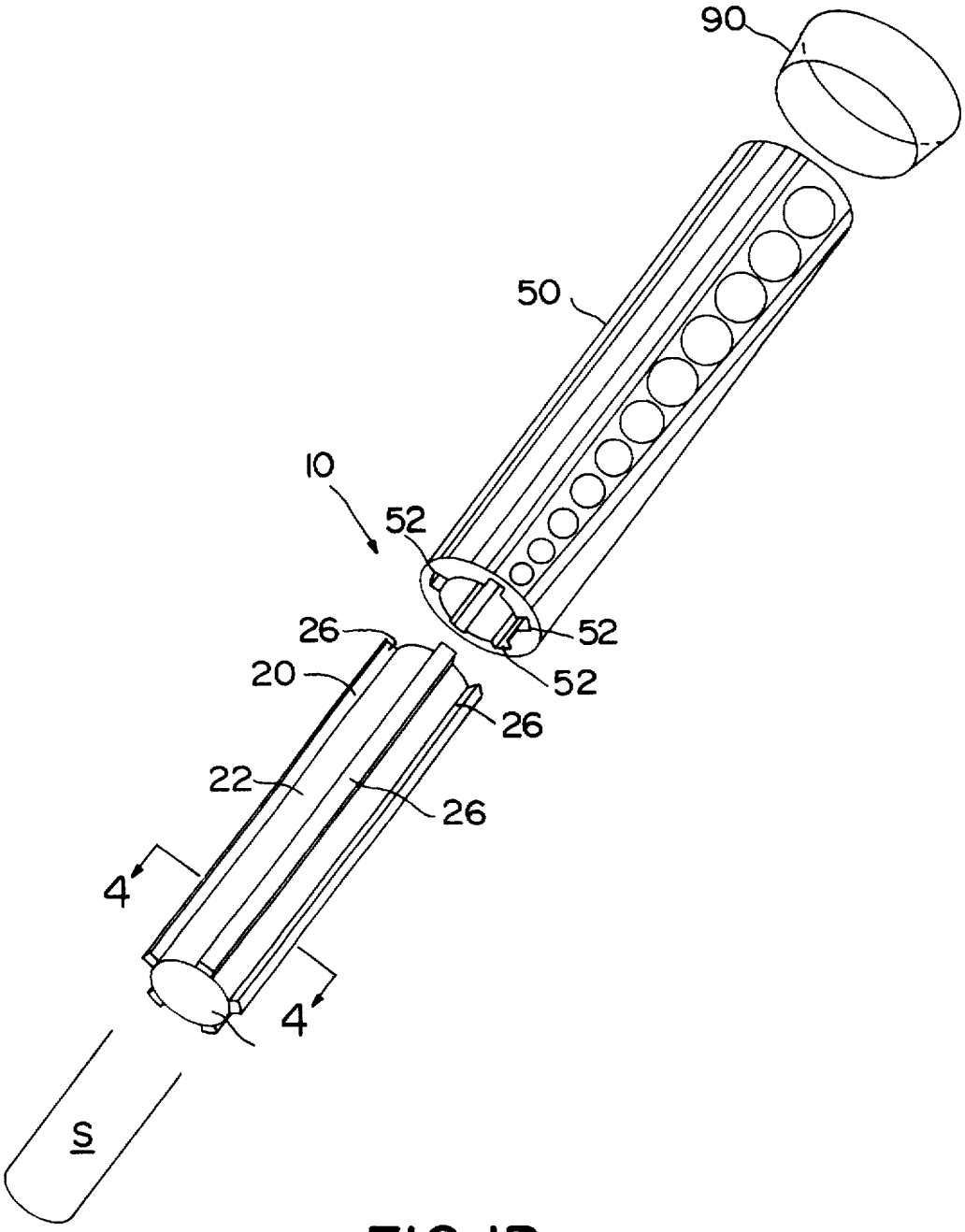
FIG. 1*b* is an exploded view, taken in perspective of the grip according to the present invention mounted on the end of a shaft.

Referring now particularly to FIGS. 1*a* and 1*b*, the grip generally indicated at 10 is mounted on a shaft S. The grip 10 comprises a sleeve 20, a tubular member 50 and an optional end cap 90, as will be more fully explained hereinbelow.

The sleeve 20 is an elongate, hollow member having an outer surface 22 and an inner surface 24. The sleeve 20 is adapted to be slidably inserted on to the end of shaft S. The sleeve 20 is fabricated from a polyolefin and is shrinkable upon the application of heat at a preselected temperature range. The polyolefin employed in the present invention is designed to shrink at temperatures between about 55 degrees C. and about 90 degrees C., somewhat lower than current shrink wrap material. The foregoing temperature range was selected as conventional hand held hair dryers found in most homes operate at this temperature and the consumer can perform the necessary operation themselves without having to purchase any additional supplies or equipment. The unique property of polyolefins is that it is molded to the finished configuration and is then expanded to a greater diameter with super heated compressed air. It is then rapidly cooled and remains in this new shape. After shrinking, the sleeve remains pliant and conforms to the shape of the shaft. The chemistry and characteristics of polyolefins are well known to those skilled in the art and a detailed discussion thereof is not deemed necessary. As employed in the present invention, the sleeve 20 may be molded or extruded (depending on whether the fins, to be discussed hereinbelow are uniform or tapered).

Figure 2:
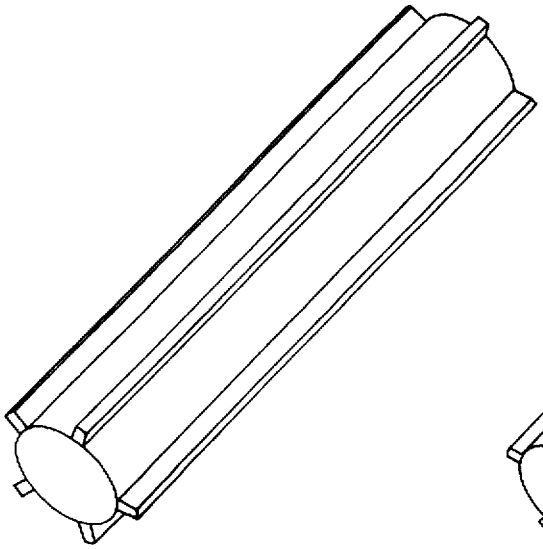
FIG. 2 is a perspective view of a first embodiment of the sleeve portion of the grip according to the present invention.
Figure 3:
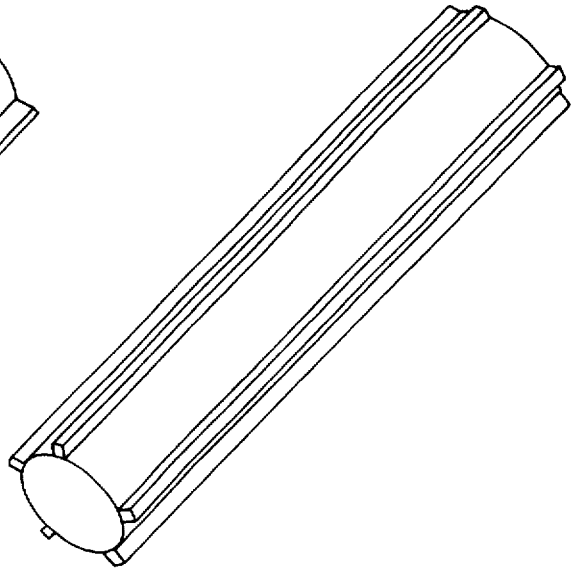
FIG. 3 is a perspective view of a second embodiment of the sleeve portion of the grip according to the present invention.
Figure 4:
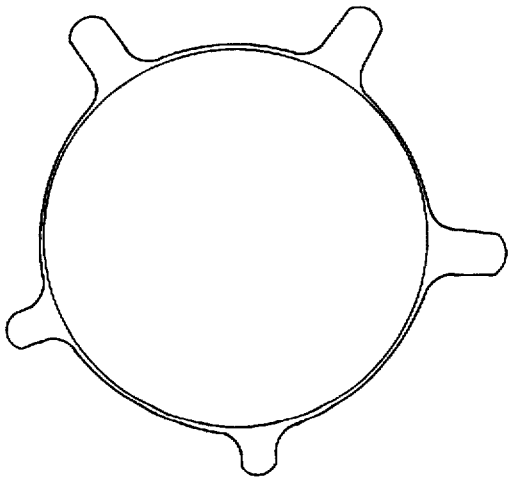
FIG. 4 is a sectional view of the sleeve portion of the grip according to the present invention taken along line 4—4 of FIG. 1.
Figure 5:
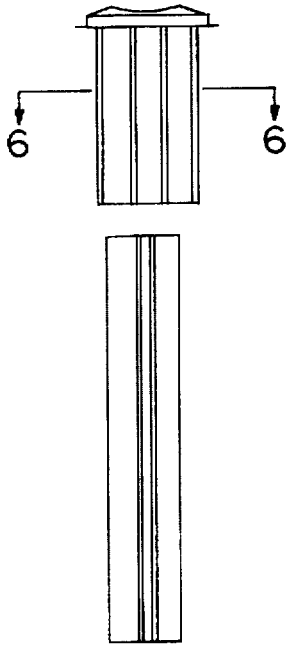
FIG. 5 is a side view of the tubular member portion of the grip according to the present invention.

The grip 10 illustrated in FIG. 1*a* comprises an inner sleeve 20, a tubular member 50 and an end cap 90. It will be noted that this embodiment differs from those others illustrated herein in that no channels or fins are required. Referring now to FIG. 1*b*, the sleeve is illustrated as having a plurality of spaced fins 26 extending along its longitudinal axis on the exterior surface thereof. It will be noted that the fins in the embodiment illustrated in FIG. 2 are uniform in height and the fins illustrated in FIG. 3 are tapered in height, being taller at one end than the other.

Figure 6:
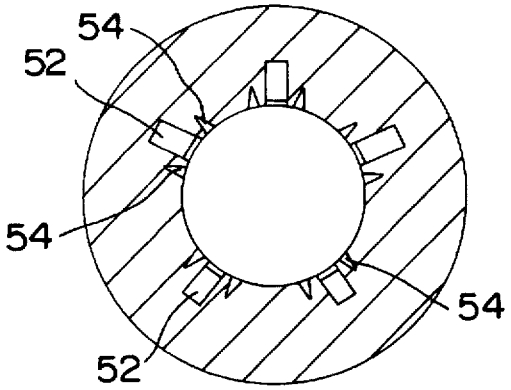
FIG. 6 is a sectional view of the tubular member taken along line 6—6 of FIG. 5.
Figure 7:
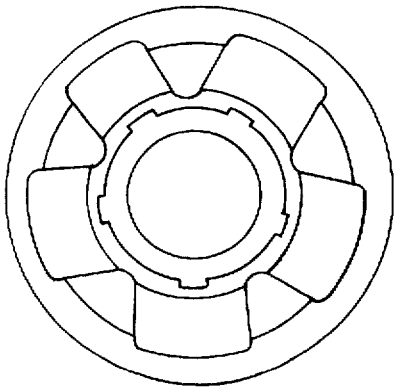
FIG. 7 is a cross sectional view of an alternate embodiment of the tubular member.
Figure 8:
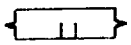
FIG. 8 is a side view of an end cap of the grip according to the present invention taken along line 8—8 of FIG. 9.
Figure 9:
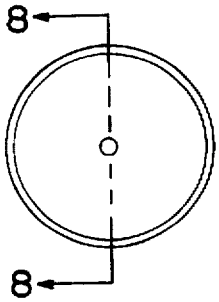
FIG. 9 is a plan view of the tubular member portion of the grip according to the present invention.
Figure 10:
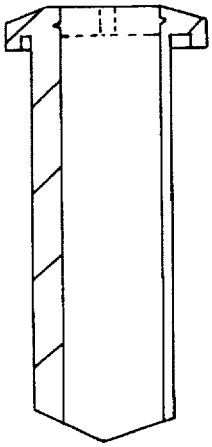
FIG. 10 is a sectional view of the tubular member portion of the grip according to the present invention.
Figure 11:
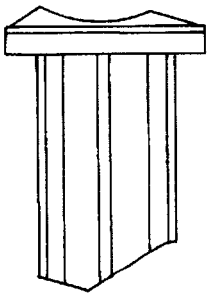
FIG. 11 is a side view of an alternate embodiment of the tubular member portion of the grip according to the present invention.
Figure 12:
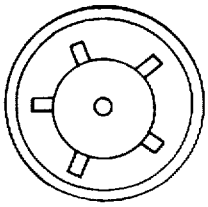
FIG. 12 is a plan view of the grip according to the present invention.
Figure 13:
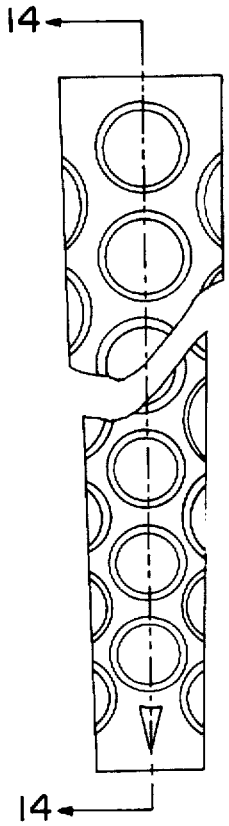
FIG. 13 is a side view of an alternate embodiment of the tubular member according to the present invention.
Figure 14:
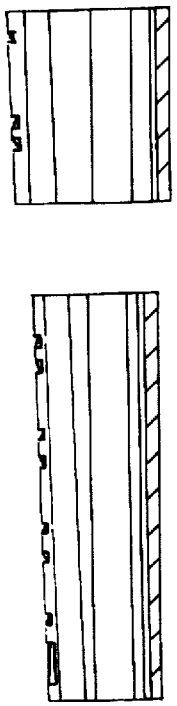
FIG. 14 is a sectional view of the tubular member taken along line 14—14 of FIG. 13.

A tubular member 50 is provided and is adapted to be slidably inserted over the sleeve 20. The tubular member 50 may include a plurality of spaced channel means 52 positioned in corresponding relation to the fins 26, such that when the tubular member 50 is slidably inserted over the sleeve, the respective fins 26 and channels 52 are in contacting mating relation. In order to accommodate shafts of varying diameter with a single grip system, the tubular member may be provided with a plurality of expansion pleats 54 (best illustrated in FIG. 6) which operate to increase the circumference of the interior diameter of the tubular member as needed. The expansion pleats 54 are positioned adjacent at least one of the channels 52 and extend along the length thereof. The pleats 54 operate in much the same manner as conventional pleats found in connection with other items, such as clothing, i.e., they stretch upon the application of force thereto. It will be noted that the sleeve 20 does not require expansion pleats as the shrink wrap process ensures a tight fit between the sleeve 20 and the shaft S.

As many types of grips are subjected to high impact impulse type forces, such as a hammer striking a nail, or a golf club striking a golf ball, additional grip strength is sometimes required. This additional strength is provided by gluing the sleeve 20 and the tubular member 50 together. A two part curing adhesive such as an epoxy adhesive 70 (having parts A and B) is used. One part of the epoxy 70 (part A) is applied to the outer surface of the sleeve 20 and the other part (part B) is applied to the inner surface of the tubular member 50. It is necessary for the respective parts A and B to remain separated until the grip 10 is assembled at which time the epoxy parts are mixed by the action of the tubular member 50 sliding over the sleeve 20 and the epoxy cures thereby bonding the sleeve 20 and the tubular member 50 together.

Figure 15:
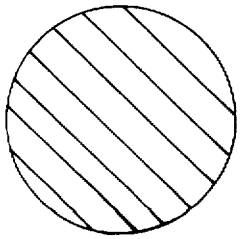
FIG. 15 is a cross sectional view of a microcapsule containing an adhesive.

In an alternate embodiment, the two parts of the epoxy adhesive are applied together to either the exterior of the sleeve 20 or the interior of the tubular member 50, preferably on the fins 26 or channels 52. However, in order to prevent premature curing of the epoxy, one of the parts is encapsulated in rupturable microcapsules 60 (FIG. 15). Upon insertion of the tubular member 50 over sleeve 20, the pressure of the surfaces sliding over each other causes rupture of the microcapsules, mixing of the adhesive constituent parts and subsequent curing thereof.

The microcapsules can range in size from about one micron to about one thousand microns, depending upon the particular application. The microcapsules are formed according to conventional methods, well known to those skilled in the art. The reader is referred to any one of the following texts for additional information on the fabrication of microcapsules:

Books on Microencapsulation

1. Vandergaer, J. E., Ed: Microencapsulation: Processes and Applications. Plenum Press, New York, 1974.
2. Gutcho, M. H.: Microcapsules and Microencapsulation Techniques. Noyes Data Corp., Park Ridge, N.J. 1976.
3. Ranney, M. W.: Microencapsulation Technology, Noyes Development Corp., Park Ridge, N.J., 1969.
4. Kondo, A.: Microcapsule Processing and Technology. Marcel Dekker, Inc., New York, 1979.
5. Nixon, J. R.: Microencapsulation. Marcel Dekker, Inc., New York 1976.

In yet another embodiment of the invention, a hot melt adhesive is applied either to the fins 26 (FIG. 1*a*) or in the channels 52. Once the tubular member 50 is in the proper position over the sleeve 20, a heat gun (such as a hand-held home hair dryer) is employed to melt the adhesive and to bond the respective sleeve and tubular member together, thusly forming an integral grip. It will be noted that in the foregoing embodiment as well those mentioned hereinabove wherein adhesive is applied to either the fins and/or the channels, that the depths of the channels on the tubular member are slightly lower than the height of the fins on the sleeve. This allows the sleeve 20 to be internally coated with the epoxy where part B is encapsulated and suspended in part A.

The top of the tubular member is open and a separate cap 90 pressure locks into the tip of the grip and is secured in place by means of the adhesive, previously described.

With respect to golf club shafts in particular, they will vary in diameter between manufacturers, but are normally tapered, being narrower at the head end of the club and wider at the grip end. In accordance with the present invention, the sleeve 20 will shrink to accommodate any size shaft. By including expansion pleats 54 in the tubular member 50, it too will accommodate any variations in diameter. Once the tubular member 50 is pulled up over the sleeve, the epoxy will seep into the pleats and will aid in securing the tubular member to the sleeve.

When attaching the grip to a shaft, the tubular member 50 is first slipped over the shaft S and thereafter, the sleeve 20 is also slipped over the end of the shaft S so that the end of the sleeve is flush with the end of the shaft. Then heat is applied to the sleeve with the heat gun to shrink wrap the sleeve 20 about the shaft. Next, the tubular member 50 is slid back down toward the end of the shaft and over the sleeve so that the respective fins 26 and the channels 52 are in alignment with one another and further, such that the tubular member 50 overlies the sleeve. Thereafter, if appropriate, heat is again applied to the tubular member about its circumference in order to melt the hot melt adhesive 70 and to fuse the sleeve and tubular member together. In the event a two part adhesive is employed, no further action is required in order to fuse the sleeve 20 and the tubular member 50 together. Lastly, if required, the end cap 90 is placed on the end of the tubular member 50 and adhesive 70 that has been forced toward the end of the shaft S is employed to hold the end cap 90 in place.

The foregoing embodiments and examples are to be considered illustrative, rather than restrictive of the invention, and those modifications which come within the meaning and range of equivalence of the claims are to be included therein.

That which is claimed is:

1. A grip for an apparatus having a shaft comprising:

an elongate hollow sleeve adapted to be slidably inserted on to the shaft, said sleeve being shrinkable upon the application of heat at a preselected temperature range so that the sleeve contracts and surroundingly attaches to the shaft, and further wherein said sleeve remains pliant and conforms to the shape of shaft upon contraction; and a tubular member adapted to be slidably inserted over said sleeve such that the outer surface of said sleeve and the inner surface of said tubular member are in contacting relation, whereby the sleeve and the tubular member together form an easily attachable grip.

2. A grip according to claim 1 further including a two part curable adhesive, the first part thereof coating the outer surface of said sleeve and the second part thereof coating the inner surface of said tubular member, whereby when the tubular member is slid over said sleeve, the adhesive mixes and is cured thereby bonding said sleeve and said tubular member together.

3. A grip according to claim 2 further including an adhesive means coating one of said respective surfaces in contacting relation.

4. A grip according to claim 2 wherein said adhesive comprises a first pad and a second part and wherein said second part is encapsulated in rupturable capsules;

whereby when said tubular member is inserted over said sleeve, the capsules rupture and the respective first and second pads are mixed together and the adhesive cures, thereby forming an integrally bonded grip.

5. A grip according to claim 4 wherein said capsules comprise microcapsules having a diameter of between 1.0 microns and 1000 microns.

6. A grip according to claim 1 wherein said adhesive comprises a hot melt adhesive such that when said tubular member is inserted over said sleeve, and thermal energy is applied thereto, the adhesive melts, thereby bonding the respective tubular member and said sleeve together into a singular integral grip.

7. A grip for an apparatus having a shaft comprising:

an elongate hollow sleeve adapted to be slidably inserted on to the shaft, said sleeve being shrinkable upon the application of heat thereto at a preselected temperature range so that the sleeve contracts and surroundingly attaches to the shaft, said sleeve further including a plurality of spaced fin means mounted to the exterior surface of said sleeve and extending along the longitudinal axis thereof, and a tubular member adapted to be slidably inserted over said sleeve, said tubular member including a plurality of spaced channel means extending along the interior longitudinal axis of said tubular member and being positioned in corresponding relation to said fins such that when the tubular member is slidably inserted over the sleeve, the fins and the channels are in contacting interlocking relation.

8. A grip according to claim 7 further including an adhesive means coating one of said surfaces in contacting interlocking relation is coated with an adhesive.

9. A grip according to claim 7 wherein said adhesive comprises a first part coating at least a portion of said sleeve and a second part coating at least part of the interior surface of said tubular member such that when the tubular member is inserted over said sleeve, the first and second parts of said adhesive are mixed and the adhesive cures, whereby an integral grip is formed from said sleeve and said tubular member.

10. A grip according to claim 7 wherein said adhesive comprises a hot melt adhesive such that when said tubular member is inserted over said sleeve, and thermal energy is applied thereto, the adhesive melts, thereby bonding the respective tubular member and said sleeve together into a singular integral grip.

11. A grip according to claim 7 wherein said adhesive comprises a two part adhesive that cures when the said respective parts are mixed.

12. A grip according to claim 7 wherein said adhesive comprises a first part and a second part and wherein said second part is encapsulated in rupturable capsules;

whereby when said tubular member is inserted over said sleeve, the capsules rupture and the respective first and second parts are mixed together and the adhesive cures, thereby forming an integrally bonded grip.

13. A grip according to claim 7 wherein said capsules comprise microcapsules having a diameter of between 1.0 microns and 1000 microns.

14. A method of attaching a grip to a shaft comprising the steps of:

sliding an elongate hollow sleeve on to the shaft, the sleeve being shrinkable upon the application of heat at a preselected temperature range so that the sleeve contracts and surroundingly attaches to the shaft, applying heat to the shaft so that the sleeve contracts and surroundingly attaches to the shaft, sliding a tubular member over the sleeve such that the outer surface of the sleeve and the inner surface of said tubular member are in contacting relation, whereby the sleeve and the tubular member together form an integral grip.

15. A method of attaching a grip according to claim 14 further including the step of:

applying the first part of a two part adhesive so as to coat the outer surface of said sleeve and the second part thereof coating the inner surface of said tubular member, whereby when the tubular member is slid over the sleeve, the adhesive mixes and is cured thereby bonding said sleeve and said tubular member together.

16. A method of attaching a grip according to claim 14 wherein the adhesive comprises a hot melt adhesive such that when said tubular member is inserted over said sleeve and thermal energy is applied thereto, the adhesive melts, thereby bonding the respective tubular member and said sleeve together into a singular integral grip.

17. A method of attaching a grip according to claim 15 wherein the adhesive comprises a first part and a second part and wherein the second part is encapsulated in rupturable capsules;

whereby when said tubular member is inserted over said sleeve, the capsules rupture and the respective first and second parts are mixed together and the adhesive cures, thereby forming an integrally bonded grip.

18. A method of attaching a grip according to claim 15 wherein the capsules comprise microcapsules having a diameter of between 1.0 microns and 1000 microns.

19. A method of attaching a grip according to claim 14 further including the step of: coating one of the respective surfaces in contacting relation with an adhesive.

20. A method of attaching a grip to an apparatus having a shaft comprising the steps of:

sliding an elongate hollow sleeve on to the shaft, the sleeve being shrinkable upon the application of heat thereto at a preselected temperature range so that the sleeve contracts and surroundingly attaches to the shaft, the sleeve further including a plurality of spaced fin means mounted to the exterior surface of the sleeve and extending along the longitudinal axis thereof, and sliding tubular member adapted to be slidably inserted over the sleeve, the tubular member including a plurality of spaced channel means extending along the interior longitudinal axis of the tubular member and being positioned in corresponding relation to said fins such that when the tubular member is slidably inserted over the sleeve, the fins and the channels are in contacting interlocking relation.

21. A method of applying a grip according to claim 20 further including the steps of:

applying a two part curable adhesive to the grip, the first part thereof coating the outer surface of said sleeve and the second part thereof coating the inner surface of the tubular member, whereby when the tubular member is slid over the sleeve, the adhesive mixes and is cured thereby bonding the sleeve and the tubular member together.

22. A method of applying a grip according to claim 20 further including the step of applying an adhesive means coating one of the respective surfaces in contacting relation.

23. A method of applying grip according to claim 20 wherein the adhesive comprises a hot melt adhesive such that when the tubular member is inserted over the sleeve and thermal energy is applied thereto, the adhesive melts, thereby bonding the respective tubular member and the sleeve together into a singular integral grip.

24. A grip according to claim 20 wherein the adhesive comprises a first part and a second part and wherein the second part is encapsulated in rupturable capsules;

whereby when the tubular member is inserted over the sleeve, the capsules rupture and the respective first and second parts are mixed together and the adhesive cures, thereby forming an integrally bonded grip.

25. A grip according to claim 20 wherein the capsules comprise microcapsules having a diameter of between 1.0 microns and 1000 microns.

* * * * *